United States Patent [19]

Blitzer

[11] 4,155,638

[45] May 22, 1979

[54] TONER CONCENTRATION MONITOR

[75] Inventor: Herbert L. Blitzer, Rochester, N.Y.

[73] Assignee: Eastman Kodak Company, Rochester, N.Y.

[21] Appl. No.: 882,722

[22] Filed: Mar. 2, 1978

[51] Int. Cl.[2] ..... G03G 15/09

[52] U.S. Cl. ..... 355/3 DD; 118/646; 141/375

[58] Field of Search ..... 118/646; 355/3 R, 3 DD, 355/14

[56] References Cited

U.S. PATENT DOCUMENTS

| | | | |
|---|---|---|---|
| 3,876,106 | 4/1975 | Rowell et al. | 355/3 DD |
| 3,922,380 | 11/1975 | Rowell et al. | 355/3 DD |
| 3,981,272 | 9/1976 | Smith et al. | 355/3 DD |

*Primary Examiner*—A. D. Pellinen

*Attorney, Agent, or Firm*—Raymond L. Owens

[57] ABSTRACT

A toner concentration monitor for use with an electrographic apparatus having an interface mechanism for receiving a replacement toner container upon removal of an exhausted toner container and also having a replenishment mechanism for dispensing fresh toner from a received container to the developer mixture to replace toner used during the development process. The monitor produces a first signal representative of the reflectivity of the developer mixture. A digital computer receives a count signal each time a replacement container is received by the interface mechanism. The computer responds to these count signals and produces an offset signal adapted to compensate for changes in the reflectivity of the developer mixture caused by the build-up of a film of toner material on the carrier particles (carrier scumming). Such scumming generally occurs in proportion to the amount of toner used. The digital computer, in response to the first signal and the offset signal, provides an accurate representation of the concentration of toner in the developer mixture. When the toner concentration is below a desired level, the computer actuates the replenishment mechanism which adds fresh toner to the developer mixture.

5 Claims, 4 Drawing Figures

TONER CONCENTRATION MONITOR

CROSS-REFERENCE TO RELATED APPLICATIONS

Reference is made to the following commonly assigned patent applications, the disclosure of which is incorporated by reference herein. U.S. Patent application Ser. No. 820,270, entitled: Toner Concentration Monitor to M. G. Reid et al, filed July 29, 1977.

BACKGROUND OF THE INVENTION

1. Field of the Invention

This invention relates to apparatus for determining the concentration of toner particles in electrographic developer mixtures. More specifically, this invention relates to toner concentration monitoring apparatus of the type wherein toner concentration is determined by sensing the reflectivity of the developer mixture. Fresh toner is added when needed to maintain the toner concentration at a desired level.

2. Description of the Prior Art

In the electrographic reproduction process, the surface of a radiation-sensitive photoconductive member which may comprise a layer of photoconductive material disposed on a conductive backing, is given a uniform electrostatic charge and is then image-wise exposed to a pattern of actinic radiation corresponding to the indicia on a document or the like being reproduced. Such exposure serves to selectively dissipate the uniform charge on the surface, leaving behind a latent electrostatic image which can then be developed by contacting it with an electrographic developer mixture.

In general, electrographic developer mixtures comprise a mixture of suitably pigmented or dyed resin-based electroscopic particles, known as toner, and a granular carrier material which functions to carry such toner and generate a triboelectric charge on such toner. The development of the latent electrostatic image occurs when the developer mixture is brought into contact with the electrostatic image-bearing surface. Such contact is commonly effected by either cascading the mixture over such surface or brushing the surface with one or more rotating magnetic development brushes, the "bristles" of which comprise chain-like arrays of toner-carrying carrier particles. Upon contacting the electrostatic image-bearing surface, the toner particles, being charged to a polarity opposite that of the electrostatic image, are separated from the carrier particles and are selectively deposited in an imagewise configuration on the image-bearing surface to form a developed image. The developed image is thereafter transferred to a paper receiving sheet and fixed thereto by any suitable means, such as heat or pressure, to form a copy of the original document. As successive toner images are formed, toner particles are depleted from the developer mixture, requiring subsequent replenishment to avoid a gradual deterioration of image quality, notably a reduction in image density.

To avoid the necessity of periodic manual replenishment and the operating difficulties often encountered as a result of over or under replenishment, the electrograhic apparatus frequently includes means for metering additional toner into the developer mixture. For example, an interface mechanism is provided for receiving a replacement toner container upon removal of an exhausted toner container. A replenishment mechanism, operatively associated with the interface mechanism, dispenses toner from a received container in response to a signal from a toner concentration monitor. Exemplary of photoelectric or optical toner concentration monitoring devices is the device disclosed in U.S. Pat. No. 3,233,781 issued to W. J. Grubbs which utilizes the reflectivity of a developer mixture having toner and carrier particles as a means for monitoring the concentration of toner particles in the developer mixture. Toner particles, usually being black, possess light absorbing surfaces and reflect less radiant energy than the carrier particles. Thus, the reflectivity of the developer mixture depends upon the relative proportions of the mixed particles. According to the Grubbs disclosure, the reflectance of the developer mixture is monitored by directing light from an incandescent lamp toward the developer mixture and detecting the light reflected by the developer mixture with a photocell. This photocell along with a similar photocell which is illuminated directly by the lamp are employed as variable resistance arms of a bridge circuit. The bridge circuit activates a toner replenishing device in response to a predetermined change in the ratio of photocell outputs, such change being characterized by an unbalance in the circuit.

A significant improvement is disclosed in commonly assigned U.S. Pat. No. 3,876,106 to Rowell et al issued Apr. 8, 1975. In the Rowell apparatus, a light emitting diode (LED) illuminates a developer mixture of toner and carrier particles. The apparatus includes first and second photosensitive means, the first being disposed to receive LED radiation reflected from the developer mixture and the second being disposed to receive radiation directly from the LED. The first and second photosensitive means produce first and second analog signals representative of the reflectivity of the developer mixture and the intensity of the radiation of the LED, respectively. The first and second analog signals are then converted to digital signals. This apparatus further includes a programmable digital computer with a stored program, which in response to such first and second digital signals produces, in accordance with such stored program, a representation of the toner concentration of the developer mixture. In response to input signals from the photosensitive means, the apparatus from time to time adds fresh toner to the developer mixture to maintain a substantially constant developer mixture reflectance.

As pointed out in the above-referenced patent application to Reid et al, it has been observed that with usage of a developer mixture, the reflectivity of the developer mixture is not always a reliable indicator of toner concentrator in the developer mixture. A portion of the change in developer mixture reflectivity is directly attributable to carrier particle scumming. Such scumming refers to the fact that as the developer mixture is used, the mechanical friction between the toner and carrier particles causes a thin film of toner material, which is not released from the carrier particles for development, to be coated on the outer surface of the carrier particles. As carrier particle scumming increases, the reflectivity of the carrier particles decreases, and consequently, the reflectivity of the developer mixture decreases below that reflectivity level which would have been obtained had there not been carrier particle scumming.

SUMMARY OF THE INVENTION

In the disclosed embodiment there is provided means for producing a first signal which is a function of the reflectivity of the developer mixture, and means responsive to the number of replacement containers received by interface means for producing an offset signal representing changes in developer mixture reflectivity caused by scumming of the carrier particles. Computation means such as a digital computer respond to the first signal and the offset signal to provide an accurate indication of the concentration of toner in the developer mixture.

A feature of this invention is the realization that an effective way of measuring developer mixture usage is to simply count the number of replacement containers received by the interface means. This number then can be translated by the computer into the offset signal.

DETAILED DESCRIPTION OF THE PREFERRED EMBODIMENT

To assist the understanding of the present invention, the operation of an electrographic copying machine in which the invention may be used will be briefly described. It is to be understood, however, that the apparatus of the present invention could be used with equal facility and advantage in other copying machines, and, therefore, the following description of apparatus related to, but not forming part of, the invention is provided for illustrative purposes only.

Electrographic Copy Apparatus

Figure 1:
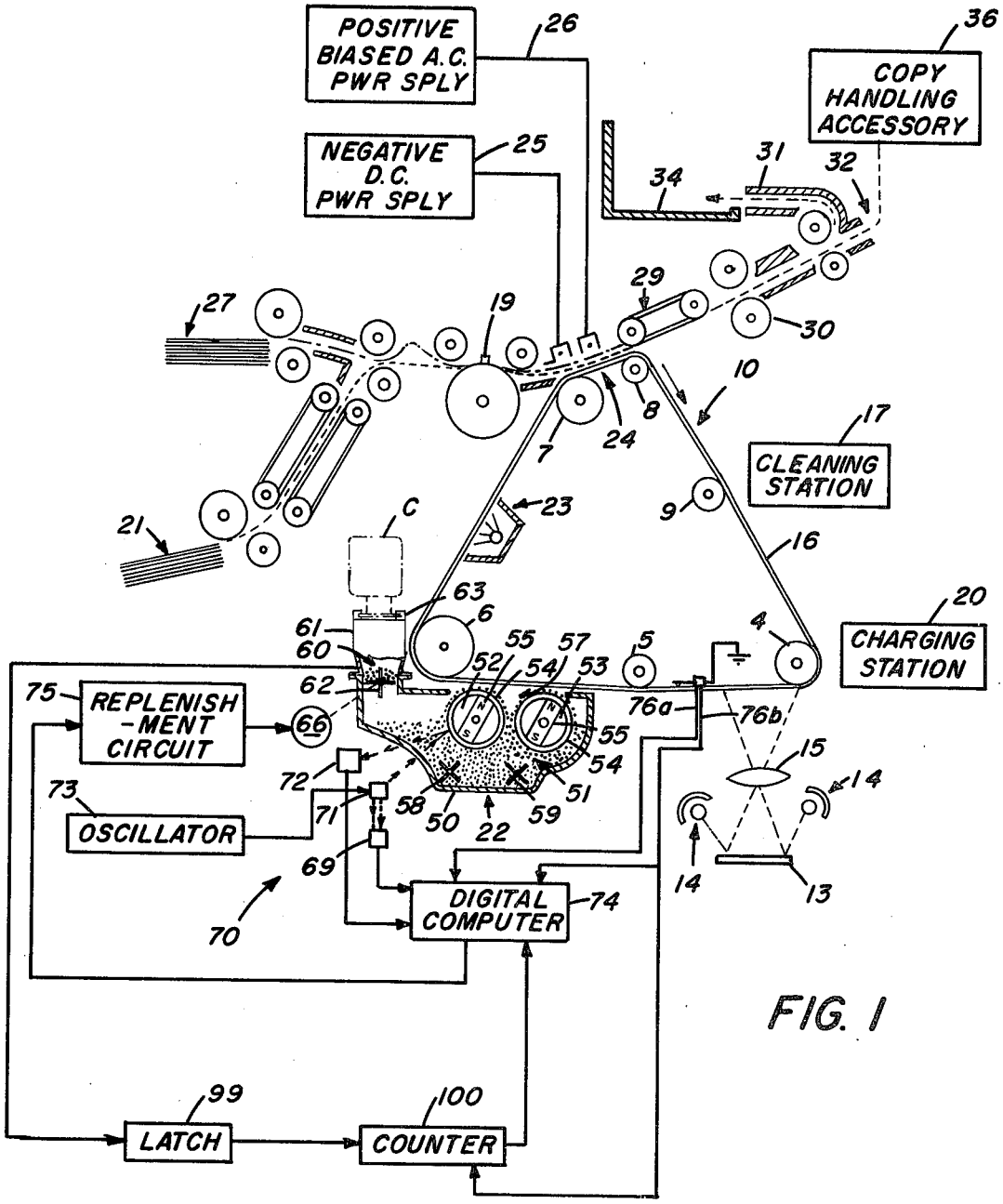
FIG. 1 is a schematic longitudinal section taken through an electrographic apparatus including a toner concentration monitor embodying the invention.

Reference is now made to FIG. 1 wherein various stations of an electrographic apparatus 10 are schematically illustrated. A charging station 20 lays down a uniform charge on a photosensitive web member 16 which is trained about rollers 4 through 9. As in some electrographic copiers, an information medium 13 such as a document is illuminated by radiation from flash lamps 14. Such radiation is reflected from the medium and projected by a lens 15 onto the photosensitive web member 16 to selectively dissipate charge and form an electrostatic latent image on the web member 16.

The apparatus 10 includes a magnetic brush development station 22 at which the moving electrostatic image is contacted by a developer mixture 51. The developer mixture has two ingredients: small polymer coated iron particles referred to as carrier particles and finely ground particles of a black pigment and polymer compound referred to as toner particles. For an example of such a mixture, see commonly assigned U.S. Pat. No. 3,938,992, entitled electrographic Developing Composition and Process Using A Fusible, Cross Linked Binder Polymer to Jadwin et al, dated Feb. 17, 1976. The toner particles adhere by electrostatic attraction to charged portions of the electrostatic image to develop and render such image visible. A post-development erase lamp 23 such as disclosed in commonly assigned U.S. Pat. No. 3,615,414 issued Oct. 24, 1971 then illuminates the web member 16.

A transfer station 24 having a DC corona device 25 causes toner particles to be transferred in an imagewise configuration from the web member 16 to a receiving surface of a copy sheet of paper. The sheets are fed seriatim from a selected one of two paper supplies 21 and 27 through a registration device 19 and then onto the photoconductive surface of the web member upstream of the transfer station 24. The copy sheet and web member 16 then move under an AC corona device 26 which renders the paper virtually neutral in charge.

A vacuum transport member 29 is located above the photoconductor at the point where the copy sheet leaves the web 16 and conveys the copy sheet into a fusing station 30. At the fusing station 30, the toner is fused to the paper by heat and pressure providing a final substantially permanent copy. The copy sheet follows either of the paths labeled 31 or 32 in exiting from the machine to either a hopper 34 or copy handling accessory 36 such as a sorter or a finisher. Finally, a cleaning station 17 is provided in which residual toner is removed from the surface of the web member 16 prior to charging.

The development station 22 includes a trough 50 for containing electrographic developer mixture 51 and a pair of magnetic development brushes 52 and 53. Each brush generally includes a rotatably mounted aluminum cylinder 54 having at least one magnetic pole piece 55, interiorly disposed in a fixed position along the longitudinal axis thereof. A pair of rotating mixing augers 58 and 59 circulate the developer mixture laterally through trough 50 and maintain the relative concentrations of the toner and carrier substantially constant throughout the trough 50. The mixing action of the augers promotes triboelectrification and, thereby, causes the toner particles to be electrostatically bound to the carrier particles.

As cylinders 54 rotate, developer mixture 51 collects on the outer surfaces thereof under the influence of the magnetic field produced by the internal pole pieces 55. As the electrostatic image-bearing surface of web member 16 tangentially contacts the developer-bearing cylinders, the superior strength of the attractive electrostatic forces in the charged image areas causes toner to be stripped from the carrier particles and selectively deposited on the web member to form toner images. As the cylinders 54 continue to rotate, the partially denuded carrier particles used in forming the toner images are moved beyond the influence of pole pieces 55 and fall back into the main body of the developer to be recoated with toner. An example of a magnetic development station 22 is more fully disclosed in commonly assigned U.S. Pat. No. 3,543,720 to Drexler et al.

A conventional toner replenisher 60 is activated by a toner concentration monitor (to be described) to maintain the concentration of toner with a range required for high quality copies. The replenisher 60 includes a hopper 61 having an opening in which is disposed a paddle wheel 62. Wheel 62 may also be in the form of a brush or soft fibrous roller. The wheel 62 is driven by a motor 66. Formed on the top of hopper 61 is an interface mechanism 63 for receiving a toner container C. An example of the toner container C and interface mechanism 63 is set forth in detail in commonly assigned U.S. Pat. No. 4,062,385 to Katusha et al. The container C is replaceable and initially contains a predetermined amount of particulate toner. A further example of a conventional toner replenisher is set forth in U.S. Pat. No. 3,409,901.

Toner Replenishment Apparatus

Figure 1A:
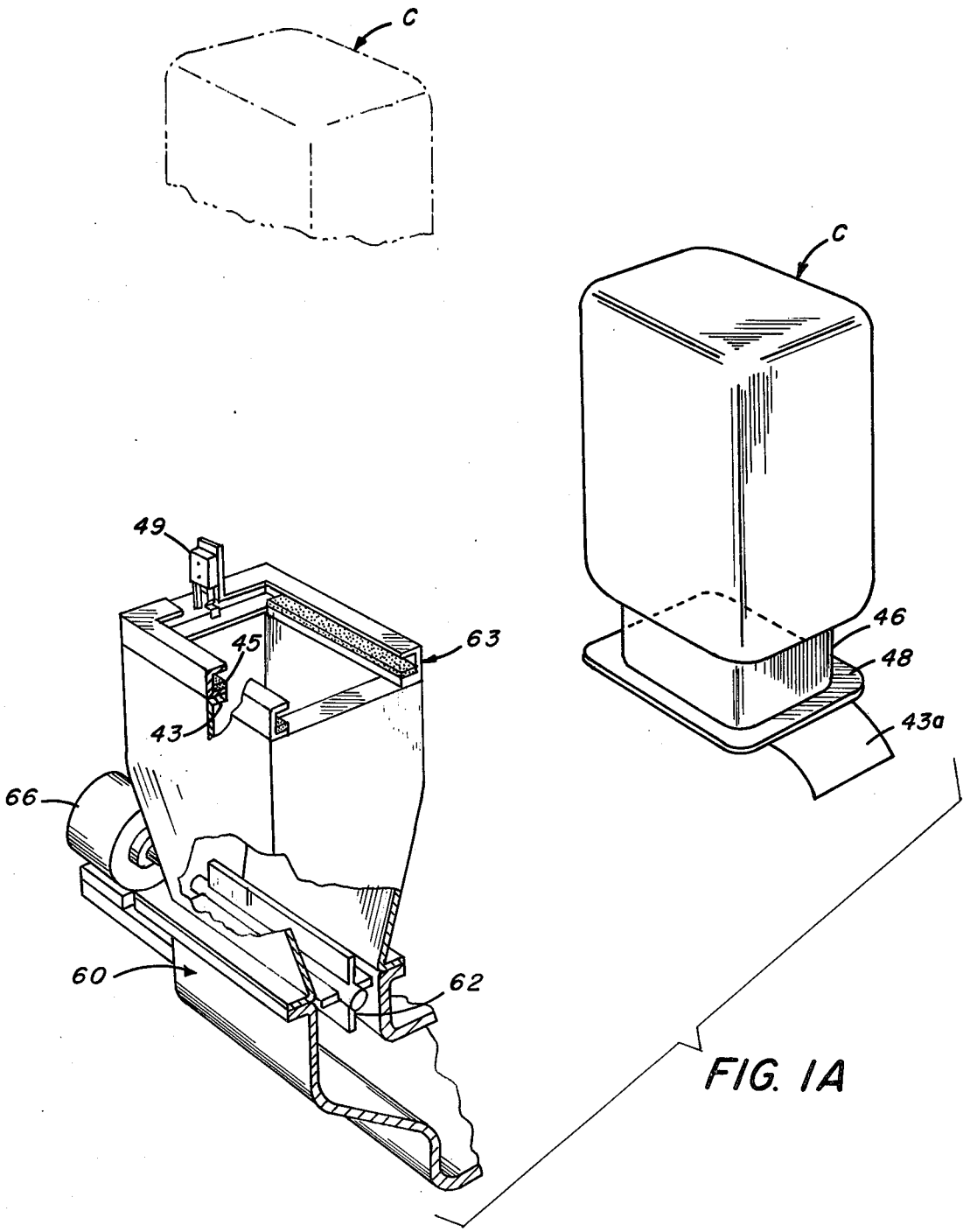
FIG. 1A is an enlarged perspective of a portion of FIG. 1 showing in detail the toner container and the interface mechanism of the electrographic apparatus.

Turning now to FIG. 1A there is shown in more detail, the toner container C and the interface mechanism 63.

The container C may be blow molded from, for example, polyethylene, polypropylene, polyallomer, or a copolymer of these resins. A neck portion 46 of the container C terminates in a rectangular shaped open end, having peripherally disposed flanges 48. A tear seal strip 432 is removably secured to the flanges 48 and prevents toner from flowing from the container C into the hopper 61 until it is removed. The interface mechanism 63 includes guide rails 43 which snugly engage the flanges 48 of the container C. A compliant member 45 is mounted on two sides of the guide rails 43 to insure a snug fit of the flanges 48 in the interface mechanism 63. Thus the container may be received by the interface mechanism by sliding the flanges 48 of the container C into an engaging relation with the guide rails 43. When the container C is disposed directly above the hopper 61, the operator removes the tear seal strip 432 and the toner in the container C drops into the replenisher 60. The wheel 62 dispenses metered quantities of toner to the developer mixture. Rotation of the wheel 62 by motor 66 is controlled by the toner concentration monitor.

A push-to-close switch 49 is mounted on the top of the rails 23. When a container C is slid into place, switch 49 is closed. When an exhausted container is removed, switch 49 opens. The switch 49 provides signals to a computer 74 which will be described later. Suffice it here to say, however, that since toner containers are only replaced when they are exhausted, signals provided by the switch 49 will provide an accurate representation of toner used in development.

Toner Concentration Monitor Apparatus

The carrier and toner particles in the developer mixture commonly have divergent reflectance characteristics, with toner having a lower reflectivity than the carrier component. As is well known, the lower the concentration of the toner particles, the higher the reflectance of the developer mixture. Stated differently, the developer 51 reflectance is inversely proportional to the toner concentration in the normal operating range. However, as the developer mixture is used, the mechanical friction between the toner and carrier particles causes a film of toner material, containing pigment from the toner particles to build up on the surface of the carrier particles (scumming). The film is not released during development. As is well known, the toner particles may be made of a black pigment and polymer compound. This toner pigment build up causes the reflectivity of the carrier particles to decrease. Thus, without some compensation, the toner concentration monitor may indicate a higher toner concentration than actually exists. Carrier scumming is directly related to the total amount of toner that is depleted during development summed over the life of a developer. In accordance with the invention the number of replacement containers are counted. As will be described hereinafter, an offset voltage signal is increased when predetermined numbers of replacement containers have been counted to compensate for changes in developer mixture reflectivity due to carrier scumming. This offset signal is added to the mixture reflectivity signal before toner concentration is computed. Alternatively, a fixed correction can be made each time a toner container is inserted; thus it is not necessary to keep a running count.

As shown in FIG. 1, there is provided a toner concentration monitor apparatus 70 which monitors the concentration of toner in the developer mixture 51. Monitoring of the reflectance of the developer mixture 51 is accomplished by directing the output of radiant energy source 71, preferably a light emitting diode, toward a portion of the developer mixture where the concentration is representative of the average toner concentration throughout the developer mixture. In the magnetic brush development station 22, the toner concentration of the developer mixture on the downstream development brush (i.e. brush 52) between the points where the brush surface emerges from the trough 50 and first contacts the surface of web member 16 is usually characteristic of the average toner concentration of the developer mixture. Between such points, the surface of the development brush is covered by developer mixture which has not yet been subjected to the localized depletion of toner as a result of developing electrostatic images.

Figure 2:
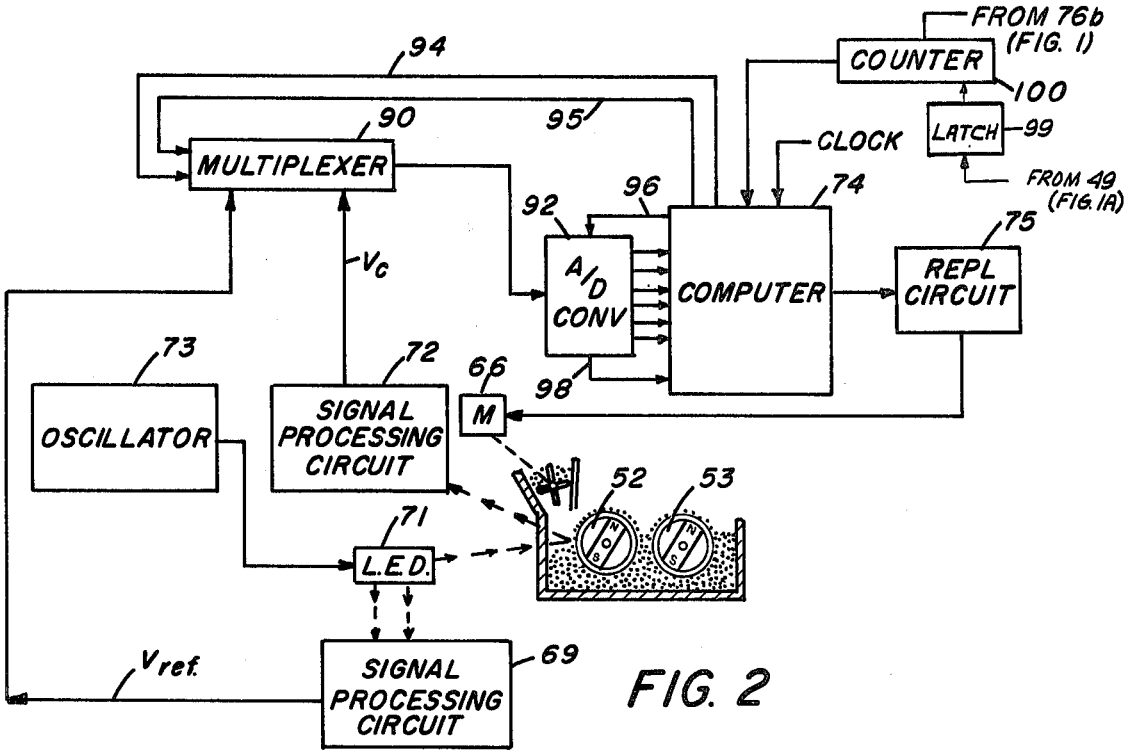
FIG. 2 is a block diagram showing in more detail the toner concentration monitor depicted in FIG. 1.

Because of its fast response time, an LED 71 can be pulsed at very high speeds. The LED 71 is actually periodically energized at a selected frequency by means of a conventional oscillator 73. Light reflected from the brush 52 is received and processed by signal processing circuitry 72. Light from LED 71 is also received by signal processing circuit 69. Circuits 69 and 72 are shown at this point for the sake of convenience in the disclosure as applying signals directly into a programmable digital computer 74. The circuits 69 and 72 will be understood to include appropriate low-pass filters. These filters aid in noise rejection. As seen in FIG. 2, these signals are actually multiplexed and converted to a digital format prior to being received by the computer 74. The computer 74 also receives input signals from a pair of electromechanical transducers **76*a* and 76*b* (referred to herein as bimorph sensors) which sense perforations in the web member 16 to provide timing information for controlling the operation of the various copier work stations. For a complete description of the structure and operation of the transducers 76*a* and 76*b* and the computer 74, see commonly assigned U.S. Pat. No. 4,025,186 to Hunt et al. Each time a container C is received by the interface mechanism 63, the switch 49 is closed and provided a signal to a latch 99. When the container is exhausted of toner and an operator removes it, the switch 49 opens and a second signal is provided to the latch 99. In response to the second signal, the latch produces an input signal to a counter 100 which totalizes such inputs. At any given time, the counter 100 contains a number equal to the number of times containers have been replaced. The computer receives signals representative of the number of replaced containers from the counter 100. Preferably, the counter 100 is a non-volatile storage memory. A non-volatile memory will be understood to be one where the loss of power will not cause a destruction of its contents. Upon installation of a new developer mixture, a serviceman should reset the counter 100**.

The LED 71 produces light in the infrared portion of the spectrum. The spectral region where developer reflectance is monitored should be chosen in accordance with the availability and operational requirements of commercial light-emitting diodes and photodetectors. The signal processing circuit 72 will be understood to include a detector device such as a phototransistor operating between base and collector junctions as a photovoltaic cell. The detected signal is amplified and converted by the circuit 72 to a DC voltage signal $V_C$. The level of signal $V_C$ represents the reflectivity of the developer mixture but is not yet compensated for carrier scumming. As shown in FIG. 2, the signal $V_C$ is applied to an analog multiplexer 90 which at the appropriate time, selected by the computer 74, provides such signal to an analog to digital (A/D) converter 92.

Since a variation in the intensity of the light from LED 71 could cause a signal to be produced by the circuit 72 which could indicate a wrong toner concentration, the computer 74 also receives a reference voltage $V_{REF}$ produced by circuitry 69. In response to signals $V_C$ and $V_{REF}$ the computer compensates for variations in light intensity. This process will now be described. The circuitry 69 receives light directly from the LED 71. In a preferred embodiment, the energy output of the LED 71 may be coupled to a detector of the circuit 69 by means of a conventional light pipe (not shown). If a light pipe is used, problems of toner dust in the optical path may be minimized. The circuit 69 detects the light, amplifies and converts it to a DC reference voltage level $V_{REF}$. The $V_{REF}$ signal is also applied to the multiplexer 90 which, at the appropriate time feeds its multiplexed output to the A/D converter 92 which in turn applies a corresponding six bit digital word into the computer 74. The arrangement is such that if the concentration of toner in the developer mixture is at the desired level the amplitude of both analog input signals $V_{REF}$ and $V_C$ are adjusted by circuits 69 and 72, respectively to have the same amplitude. Stated mathematically $V_{REF}-V_C=0$. However, and again assuming no carrier scumming, if the mixture reflectivity is reduced, $V_C$ will diminish and $V_{REF}-V_C$ will be a positive number which indicates that the toner concentration is above the desired level.

In order to process signals from the circuits 69 and 72, the computer 74 produces multiplexer channel address select signals to sequentially switch inputs to the A/D converter 92. These signals are sequentially produced after a perforation has been detected by sensor **76*b* shown in FIG. 1. Thereafter, start signals are produced in the lead 96 which causes the A/D converter 92 to perform a conversion of input analog data into six bit digital words. Upon completion of each such A/D conversion process, the converter produces a completion signal which is delivered to the computer 74 via a lead 98. This completion signal causes the computer in the appropriate sequence in its program to accept the data from A/D converter 92. As noted above, the sequencing of the computer is in turn coordinated as a function of the input signals provided by the transducers 76*a* and 76*b* upon sensing the perforations in the web member 16. If the computer determines toner is to be added to the mixture it provides an output signal to the replenishment circuit 75 which in turn energizes the replenishment motor 66. The circuit 75 will continue to receive these output signals until the computer 74** determines that the toner concentration is back within a desired range. Also, the computer may be programmed to monitor the magnitude of toner concentration and provide output generator alert signals if the toner concentration becomes either too high or too low.

The computer 74 also received a signal from counter 100 representative of the number of replaced containers. This number is directly related to the usage of toner in the developer mixture and is indicative of carrier particle scumming. The computer includes in memory a lock up table which has an offset voltage signal $V_{offset}$ corresponding to each number. The computer then adds the signal $V_{offset}$ to $V_C$. Stated mathematically this becomes $(V_{REF}-V_C+V_{offset})/V_{REF}$. A number is computed which is equal to zero when no toner is needed. If it is a negative number, such number represents that the toner concentration is below the desired level and the computer may require an addition of fresh toner. It will be understood that the relationship between numbers of replacement containers, and corresponding offset voltages will have to be determined experimentally depending upon the volume of toner held in the containers and the scumming properties of the carrier particles.

For a specific example, let us assume for the sake of explanation that the computer automatically increases the voltage $V_{offset}$ at predetermined numbers of replaced containers to compensate for the change in developer mixture reflectivity due to carrier summing.

Figure 3:
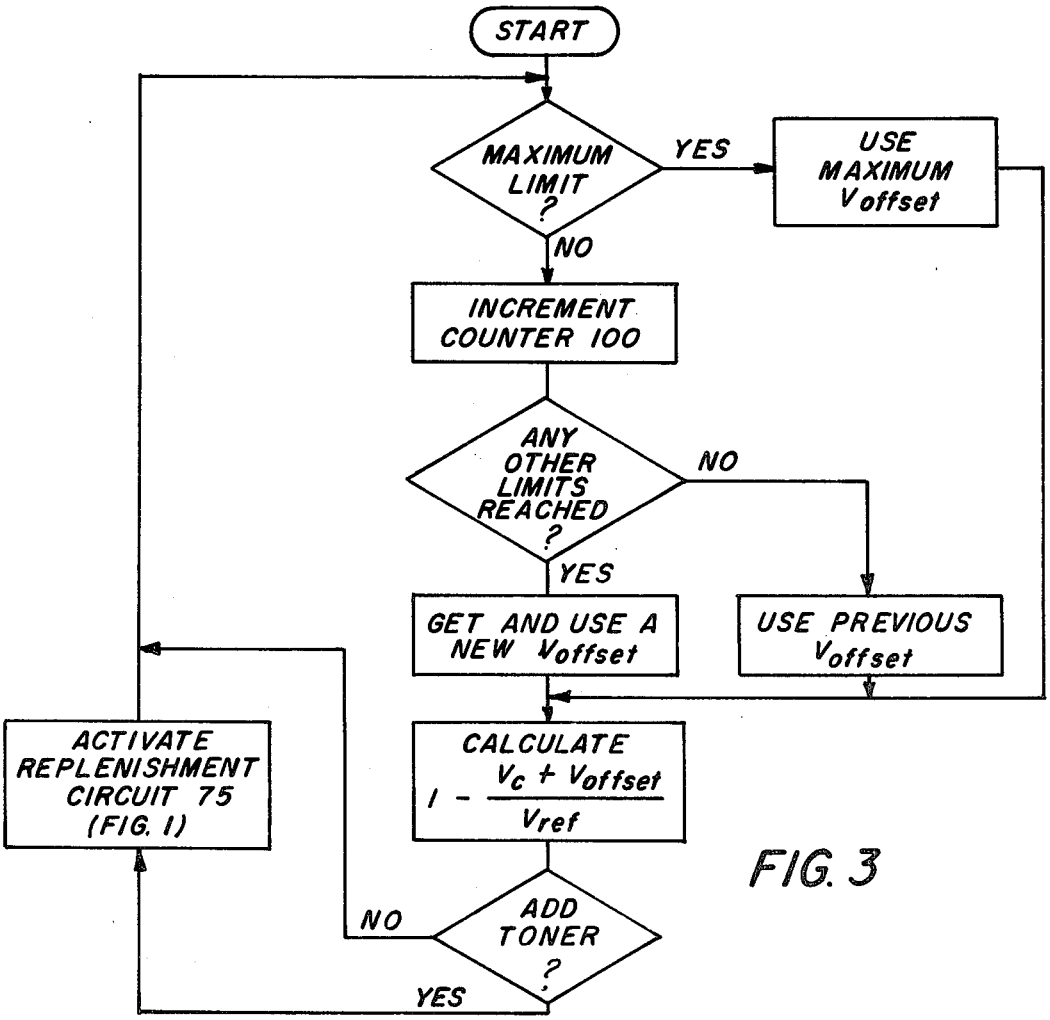
FIG. 3 is a flow diagram for the toner concentration monitor of FIG. 2.

FIG. 3 depicts a flow chart which describes the process the computer 74 uses to calculate toner concentration. First the computer determines if the total number of replaced containers is equal to or exceeds the maximum limit. If the answer is yes, then the maximum $V_{offset}$ is used by the computer to calculate $1-[V_C+V_{offset}/V_{REF}]$. Next the computer 74 determines, if a negative number is calculated. If it is negative, toner is needed and the replenishment circuit 75 is activated, motor 66 energized, and fresh toner added to the developer mixture.

Returning to the beginning of the flow chart, let us assume that the maximum limit was not reached. After a container is replaced, the counter 100 is incremented by one. The next decision to be made is: are any other limits reached. If the answer is no, the previous $V_{offset}$ will be used. On the other hand, if a limit is reached, then a new $V_{offset}$ will be used in the calculation by the computer.

Reviewing, the computer 74 at predetermined exposure intervals, computes $1-[(V_C+V_{offset})/V_{REF}]$. If the number computed is negative, then fresh toner is added. $V_{offset}$ is introduced to compensate for loss of reflectivity of the developer mixture due to carrier scumming that occurs with aging of the developer mixture.

Pursuant to the invention, the number of replacement containers received by the interface mechanism is counted. This number is translated by the computer into an offset voltage signal.

The invention has been described in detail with particular reference to a preferred embodiment thereof, but it will be understood that variations and modifications can be effected within the scope of the invention.

We claim:

1. A toner concentration monitor for detecting the depletion of toner from a developer mixture of toner and carrier particles during use of the mixture in an electrographic apparatus having interface means for receiving a replacement toner container upon removal of an exhausted toner container, said monitor comprising:

(a) means for projecting radiant energy upon a portion of the developer mixture to illuminate the same;

(b) means disposed to receive radiant energy reflected from the developer mixture and in response thereto to produce a first signal representative of the reflectivity of such developer mixture;

(c) means responsive to a toner container replacement on said interface means for producing a second signal representative of scumming of the carrier particles of such developer mixture; and (d) computation means responsive to said first and second signals for producing a representation of the concentration of toner in the developer mixture.

2. The invention as set forth in claim 1 including an actuable replenishment means effective when actuated for dispensing toner from the received container into the developer mixture to replace toner depleted from the developer mixture; said computation means actuating said replenishment means to dispense toner into the developer mixture when the concentration of toner is below a desired level.

3. A method for determining toner concentration of a mixture of carrier and toner particles employed in a development process wherein toner is added to the mixture from containers which are replaced after they are exhausted of toner, comprising the steps of:

(a) projecting radiant energy upon a portion of the developer mixture to illuminate the same;

(b) receiving radiant energy reflected from the developer mixture and in response thereto producing a first signal representative of developer mixture reflectivity;

(c) counting the number of replaced containers;

(d) producing an offset signal in response to the commulative number of replaced containers;

(e) computing a representation of toner concentration in response to said offset signal and said first signal.

4. A toner concentration monitor for detecting and replenishing depleted toner from a developer mixture of toner and scumable carrier particles during use of the mixture in an electrographic apparatus having interface means for receiving a replacement toner container upon removal of an exhausted toner container, said monitor comprising:

(a) a radiation source for projecting radiant energy upon a portion of the developer mixture to illuminate the same;

(b) means disposed to receive radiant energy reflected from the developer mixture and in response thereto to produce a first signal representative of the reflectivity of such developer mixture;

(c) means responsive to the replacement of a container received by said interface means for producing a second signal representative of scumming of the carrier particles of such developer mixture which is correlated to the number of containers which have been so received;

(d) computation means responsive to said first and second signals for producing a third signal representative of the concentration of toner in the developer mixture; and (e) replenisher means responsive to said third signal when the toner concentration is below a desired level for dispensing toner from a received container into the mixture.

5. In electrographic apparatus including interface means for receiving a replacement container upon removal of an exhausted toner container, and a toner concentration monitor of the type which detects the depletion of toner from a developer mixture of toner and carrier particles in response to radiation reflected off the mixture, the improvement comprising:

means for producing a representation of carrier particle scumming in response to toner container replacement on said interface means.

* * * * *